US005743128A

United States Patent [19]

Liet

[11] Patent Number: 5,743,128

[45] Date of Patent: Apr. 28, 1998

[54] APPARATUS FOR BENDING METAL SHEET

[76] Inventor: Cornelis Hendricus Liet, Denekamperdijk 38, NL-7581 PJ Losser, Netherlands

[21] Appl. No.: 654,697

[22] Filed: May 29, 1996

[30] Foreign Application Priority Data

May 31, 1995 [NL] Netherlands ..... 1000459
Mar. 8, 1996 [NL] Netherlands ..... 1002553

[51] Int. Cl.[6] ..... B21D 5/04

[52] U.S. Cl. ..... 72/319; 72/323

[58] Field of Search ..... 72/319, 320, 323, 72/316, 306

[56] References Cited

U.S. PATENT DOCUMENTS

| | | | |
|---|---|---|---|
| 2,312,021 | 2/1943 | Bowman | 72/319 |
| 2,325,736 | 8/1943 | Bowman | 72/319 |
| 4,510,785 | 4/1985 | Triouleyre | 72/319 |
| 5,313,814 | 5/1994 | Yamamoto | 72/319 |

FOREIGN PATENT DOCUMENTS

| | | |
|---|---|---|
| 0 039 322 A1 | 11/1981 | European Pat. Off. . |
| 0 490 828 A1 | 6/1992 | European Pat. Off. . |
| 2 307 592 | 11/1976 | France . |
| 2 686 276 A1 | 7/1993 | France . |
| 3605815 A1 | 8/1987 | Germany . |
| 42 06 417 A1 | 9/1993 | Germany . |
| 94 04 308 | 9/1994 | Germany . |

*Primary Examiner*—David C. Crane
*Attorney, Agent, or Firm*—Westman, Champlin & Kelly, P.A.; S. Koehler

[57] ABSTRACT

An apparatus for bending metal sheet comprises a frame (1), a stationary lower beam (2) with a lower clamp (5) and a movable upper beam (3) with an upper clamp (6). The clamps each have a clamping face for clamping a metal sheet in a working position. The apparatus further comprises a lower bending beam (13) and/or an upper bending beam (14) for bending upwardly or downwardly, respectively, a clamped metal sheet. At both sides the bending beam(s) is/are supported in the frame rotatably around an axis and independent of the upper and/or lower beam. The body of the lower or upper bending beam (13, 14) in a working starting position extends substantially perpendicular to the clamping face and the lower and upper clamps (5, 6) determine in cross-section in the working position a V-shape, the apex of which is directed towards the axis (15, 16) of the bending beam being in the working position.

20 Claims, 6 Drawing Sheets

APPARATUS FOR BENDING METAL SHEET

BACKGROUND OF THE INVENTION

The invention relates to an apparatus for bending metal sheet, comprising a frame, a stationary lower beam with a lower clamp, a movable upper beam with an upper clamp, said clamps each having a clamping face for clamping a metal sheet in a working position, a lower bending beam and/or an upper bending beam for bending upwardly or downwardly, respectively, a clamped metal sheet, said bending beam(s) at both sides being supported in the frame rotatably around an axis and independent of the upper and/or lower beam.

Such an apparatus is known from DE-A-36 05 815. In this known apparatus the upper bending beam in its working starting position is directed with its body obliquely to the plane of the clamping face and thereby obliquely to the metal sheet to be bended. Thereby reaction forces occur during bending a metal sheet which forces are directed obliquely to the body of the bending beam so that the bending beam can deform relatively easily. Further, the clamps of the upper and lower beams are mutually perpendicular and are perpendicular with respect to the clamping face in this known apparatus, whereby reaction forces may occur during bending a metal sheet which forces are directed perpendicular to the body of the clamps and may cause deformation of the clamps. Said deformations of clamps and upper bending beam result in a product with insufficient accuracy.

Further, an apparatus for bending metal sheet is known from DE-A-42 06 417, wherein the clamps in the working position determine a V-shape in cross-section, the apex of which is directed towards the axis of the bending beam being in the working position. In this known apparatus the lower bending beam is connected slidably and pivotably to the lower beam and the upper bending beam is connected slidably and pivotably to the upper beam. The pivot connection is provided by a rather complicated system of rods with a high number of rotation points making the system of rods rather vulnerable. Moreover, the reaction forces on the upper bending beam are received by the upper beam, whereby the clamping force on the metal sheet is strongly reduced or may even be reduced to zero, which may result in an inaccurate product.

It is an object of the invention to provide a simplified apparatus of the above-mentioned type having a robust construction and thereby a long life and by means of which products with a high accuracy can be manufactured.

SUMMARY OF THE INVENTION

The invention provides an apparatus for bending metal sheet, comprising a frame, a stationary lower beam with a lower clamp, and a movable upper beam with an upper clamp. The clamps each have a clamping face for clamping a metal sheet in a working position, a lower bending beam and/or an upper bending beam for bending upwardly or downwardly, respectively, to clamp a metal sheet. The bending beam(s) at both sides are supported in the frame rotatably around an axis and independent of the upper and/or lower beam, wherein the body of the lower or upper bending beam in a working starting position extends substantially perpendicular to the clamping face and where the lower and upper clamps determine in cross-section in the working position a V-shape, the apex of which is directed towards the axis of the bending beam being in the working position.

In this manner an apparatus is obtained, wherein by a simple independent support of the bending beam(s) in the frame the bending beam in its working starting position is perpendicular to the plane of the clamping face and the occurring reaction forces on bending beam(s) and clamps can cause no deformation anymore and the clamping force is not affected by the forces on the bending beam.

BRIEF DESCRIPTION OF THE DRAWINGS

The invention will be further explained by reference to the drawings in which two embodiments of the apparatus according to the invention are schematically shown.

DETAILED DESCRIPTION OF THE PREFERRED EMBODIMENTS

Figure 1:
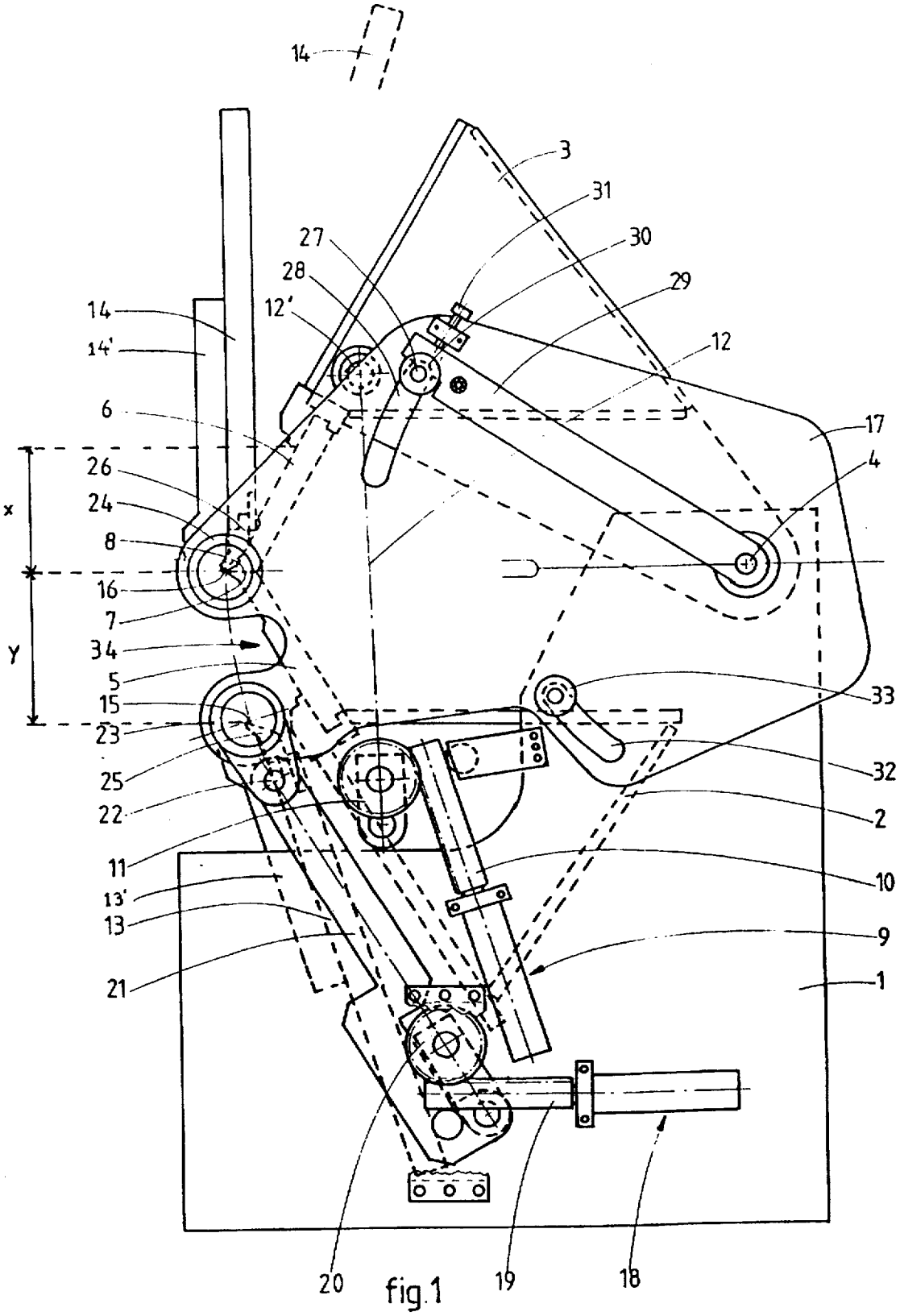
FIG. 1 is a schematically shown sideview of an apparatus for bending a metal sheet.
Figure 2:
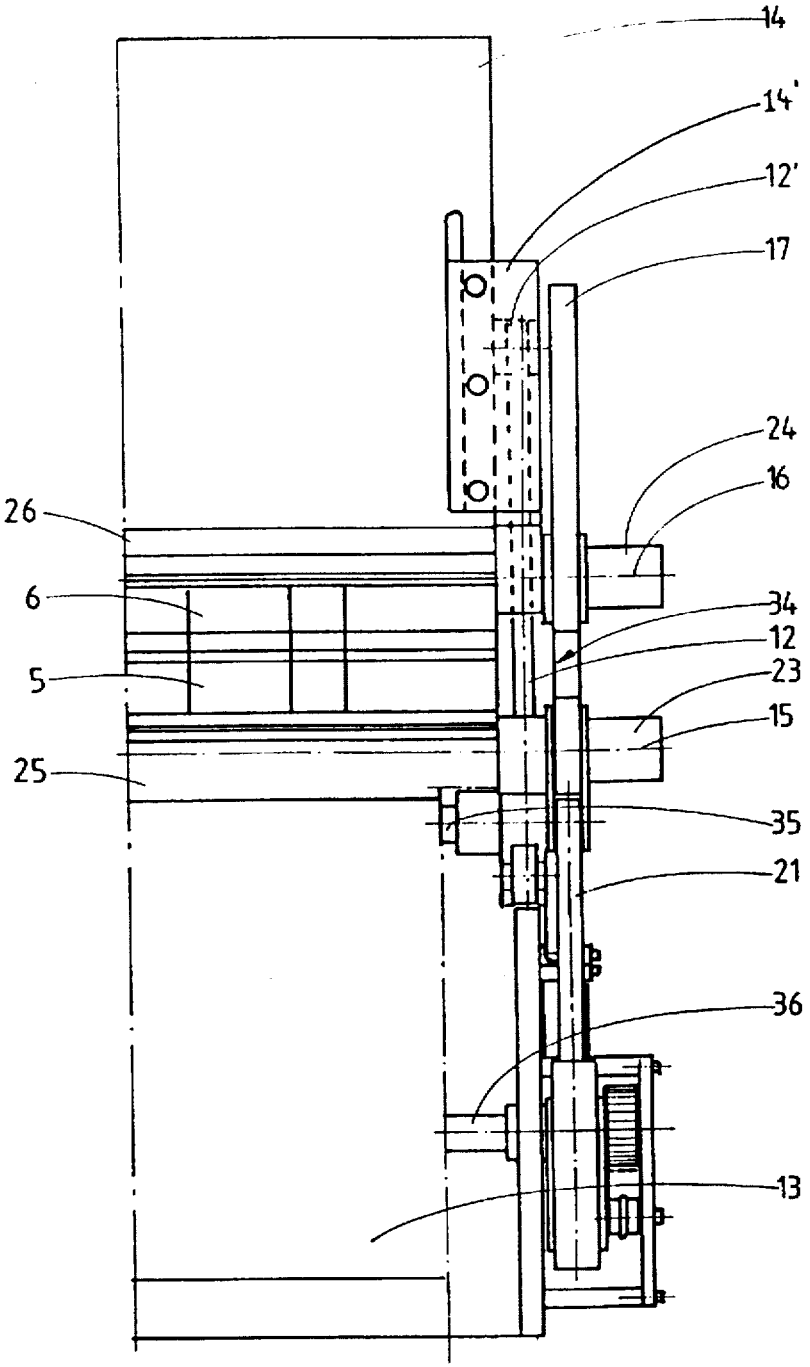
FIG. 2 is a partially shown front view of the apparatus of FIG. 1.
Figure 3:
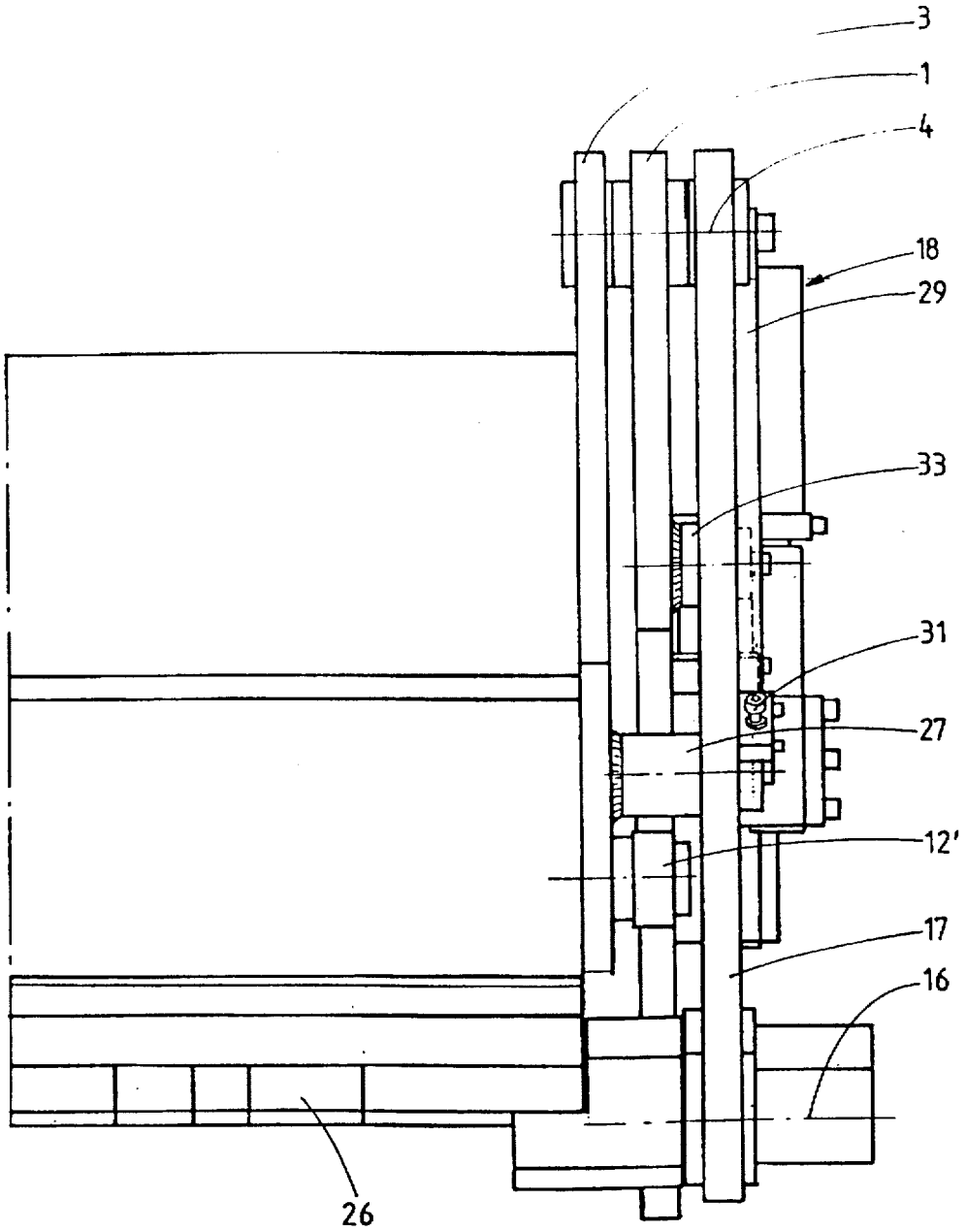
FIG. 3 is a partially shown top view of the apparatus of FIG. 1.

In FIGS. 1–3 there is schematically shown an apparatus for bending a metal sheet, comprising a frame, of which only a side plate 1 can be seen in FIG. 1. A stationary lower beam 2 is provided between both side plates 1 whereas the side plates 1 further support an upper beam 3 which is rotatably around an axis 4. The lower beam 2 is provided with a lower clamp 5 which can be assembled of a plurality of parts as shown in the front view of FIG. 2. In the same manner the upper beam 3 has an upper clamp 6 which is also assembled of a plurality of parts. The number of parts of the clamps 5, 6 is for example dependent on the length of the metal sheet to be bended. In the position of the upper beam 3 shown in the drawings, the clamps 5, 6 are resting with their clamping faces 7 and 8, respectively, one upon the other. During operation of the apparatus the clamps 5, 6 clamp with their clamping faces 7, 8 a metal sheet to be bended. FIG. 1 shows that the clamps 5, 6 in this working position determine a V-shape in cross-section, the apex of which is directed towards the front side of the apparatus. Further, the lower and upper beams 2, 3 have a triangular cross-section, wherein the front triangular side is substantially aligned with the corresponding clamp 5, 6. By this construction and position of the clamps 5, 6 very high reaction forces can be received.

As shown in FIG. 1 the length of the clamps 5, 6 is substantially greater than the thickness thereof. The length is at least three times and preferably at least five times the thickness. By this form of the clamps 5, 6 and the V-shaped position, it is obtained that the reaction forces occurring during bending are directed to the backside of the apparatus, i.e. opposite to the direction into which the V-shape is directed, which will increase the clamping force exerted by the clamps 5, 6 on the clamped metal sheet, and whereby movement of the metal sheet or undesired deformation of the clamps 5, 6 is prevented. It is noted that the term length of the clamps 5, 6 used in this specification, is used for the length of the part protruding from the corresponding beam 2 or 3. This part may comprise an assembly of a holder and a clamp.

The upper beam 3 is pivotable around the axis 4 by means of a cylinder-piston assembly 9, the piston rod of which drives a rack 10 cooperating with an eccentric 11 which is coupled with the upper beam 3 at 12' through a pulling rod 12 indicated by a dashed line.

The apparatus further comprises a lower bending beam 13 and an upper bending beam 14, said bending beams each at both sides being supported in a pivot plate 17 rotatably around an axis 15 or 16, respectively, by means of support plates 13' and 14', only one pivot plate being shown in the drawings. In the embodiment described this pivot plate 17 is rotatably borne in the side plates 1 around the axis 4. The pivot plates 17 are pivoted by means of a cylinder piston assembly 18, the piston rod of which drives a rack 19 which drives an eccentric 20 coupled with the pivot plate 17 by a pulling rod 21. The pulling rod 21 is connected with the pivot plate 17 at 22 in a rotatable manner.

It is noted that instead of pivot plates 17 it is possible to use slidable support plates for the bending beams 13, 14. It is only important that the support plates or pivot plates support the bending beams 13, 14 in the apparatus independently of the lower and upper beams 2, 3. Thereby, the clamping force is independent of the reaction forces occurring during bending the metal sheet.

If slidable support plates 17 are used, each support plate is preferably guided at at least two locations in the frame 1. Preferably at least one guiding location is provided at the other side of the V-shape determined by the clamps 5, 6 with respect to the axes 15, 16. It is further preferred if one guiding location is located above and one guiding location is located below the axes 15, 16.

The lower bending beam 13 is rotatable around the axis 15 and in the embodiment of FIGS. 1–3 is drivable by means of a driving motor 23, while the upper bending beam 14 is rotatable around the axis 16 and in this embodiment is drivable by means of a motor 24.

Both bending beams 13, 14 are provided with a bending element 25 and 26, respectively, wherein said bending elements in the same manner as the clamps 5, 6 can be assembled of several parts depending on the length of the metal sheet to be bended. In FIG. 1 it is shown that the end of the bending elements 25, 26 extends from the front face of the corresponding bending beam 13, 14 obliquely outwardly towards the corresponding axis 15, 16. Thereby the front face of the bending beam 13, 14 lies in its starting position behind the vertical plane of the axis 15 or 16, so that the bending beam 13 or 14 does not form an obstruction for an possibly earlier bended part of the metal sheet. Thereby products can be manufactured with closely spaced bending lines. Further, FIG. 1 shows that the distance y between the axes 15, 16 is greater than the vertical height x of the clamp 6 of the upper beam 3. The distance y between the axes 15, 16 may be equal to the vertical height x but is preferably not less.

In the position of the pivot plates 17 shown in FIG. 1, the upper bending beam 14 is in the working starting position, wherein the axis 16 around which the upper bending beam 14 is rotatable, is located in the plane of the clamping face 8 of the upper clamp 6. By pivoting the pivot plates 17 upwardly by means of the cylinder piston assembly 18, the lower bending beam 13 arrives in the working starting position wherein the axis 15 is located in the plane of the clamping face 7 of the lower clamp 5. From the drawings it will be clear that the axes 15, 16 in the working position of the corresponding bending beam 13, 14 are each located at the front side of the apparatus, i.e. the apex of the V-shape of the clamps 5, 6 is directed towards the axis 15 or 16. Further, the body of the bending beam 13, 14 located in the working starting position is substantially perpendicular to the clamping face and thereby perpendicular to the metal sheet to be bended, whereby high reaction forces can be taken without deformation of the bending beam.

As shown in the drawings, the axis 4, around which the upper beam 3 and the pivot plates 17 are rotatable, is located at the backside of the apparatus, whereas the axes 15, 16 of the bending beams 13, 14 are located at the other side of the clamps 5, 6 with respect to the axis 4. This construction is possible because the pivot plates of the beam 3 are located at the inner side of the pivot plates 17 of the bending beams 13, 14. Thereby a very compact construction of the apparatus is obtained, wherein the front side of the apparatus remains free for activities of operators, such as adjusting the apparatus, testing the adjustments or at small series feeding and removing metal sheets to be bended. With a slidable guidance of the support plates 17, this guidance is also preferably at the backside of the apparatus.

In the apparatus described the axis 4 of the upper beam 3 and the pivot plates 17 is located in the plane of the clamping face 7, 8 of the clamps 5, 6, whereby it is obtained that at pivoting the pivot plates 17 the axes 15, 16 will always be in the correct position in the plane of the corresponding clamping face 7, 8, wherein the distance between the clamping elements 25, 26 and the clamps 5, 6 are always the correct value.

In the embodiment shown the upper beam 3 is provided with a stop element 27 made as a round rod extending through an arcuate slot 28 of the pivot plate 17. The centre of this slot 28 coincides with the axis 4. The pivot plate 17 is further provided with a stop arm 29. The stop arm 25 is rotatable around the axis 4 and has a recess 30 adapted to cooperate with the stop element 27. An adjustment means 31 is provided on the support plate 17 for adjusting the position of the stop arm 29 with respect to the slot 28 once-only. This adjustment is made in such a manner that in the position of the pivot plates 17 shown in FIG. 1, the axis 16 of the upper bending beam 14 is located in the plane of the clamping face 8 of the upper clamp 6 of the upper beam 3. Thereby it is obtained that independent of the thickness of the sheet to be bended, the upper bending beam 14 will always be in the correct position with respect to the upper beam 3.

It is noted that the pivot plate 17 can also be provided with a stop means made in a different manner as the stop arm 29. The adjustment means 31 may for example directly support a stop means.

In a corresponding manner the pivot plate 17 is provided with an arcuate slot 32 the centre of which also coincides with the axis 4. A stop element 33 is mounted on the side plate 1 for determining the upwardly pivoted position of these pivot plates 17 with respect to the lower beam 2 in such a manner that the axis 15 of the lower bending beam 13 is in the correct position in the plane of the clamping face 7 of the lower clamp 5.

A recess 34 is provided in the pivot plates 17 between both axes 15, 16 of the bending beams 13, 14, said recess being directed from the front side towards the axis 4. When the pivot plates 17 are located with said recess 34 at the height of the clamping faces 7, 8, a bent metal sheet can be removed sidewardly from the apparatus through this recess 34.

It is noted that the apparatus described is made in the same manner at both sides, i.e. the left side of the apparatus is the mirror image of the views of FIGS. 2 and 3. The corresponding eccentrics 11 and 22, respectively, lying at both sides, are interconnected by a shaft 35 and 36, respectively (see FIG. 3).

Driving the bending beams 13, 14 by the driving motors 23, 24 generally made as hydraulic motors, is rather costly because four motors are required and because an accurate control of these motors at both sides of the apparatus is necessary.

Figure 4:
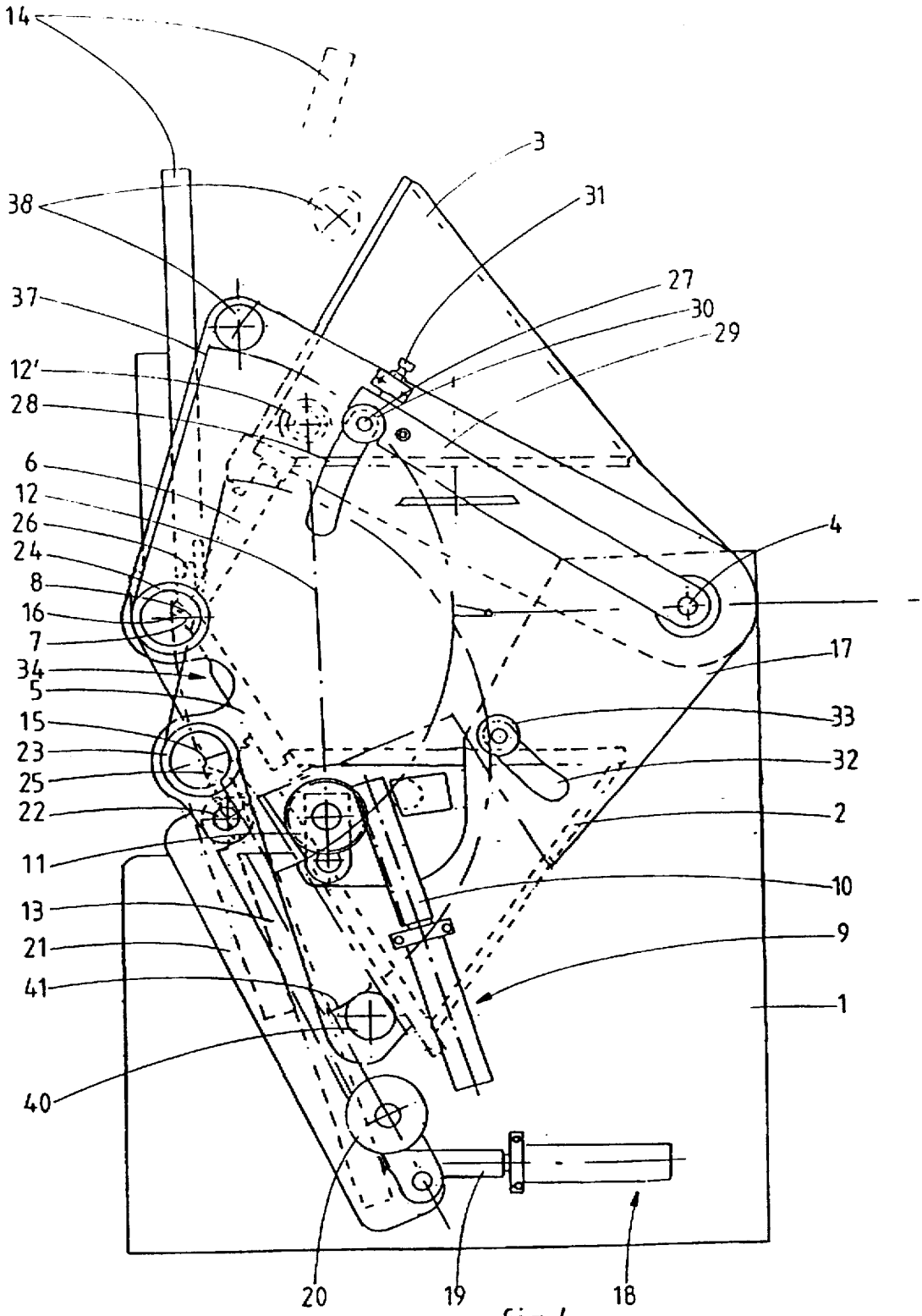
FIGS. 4–6 are views corresponding with FIGS. 1–3 of a second embodiment of the apparatus for bending a metal sheet.
Figure 5:
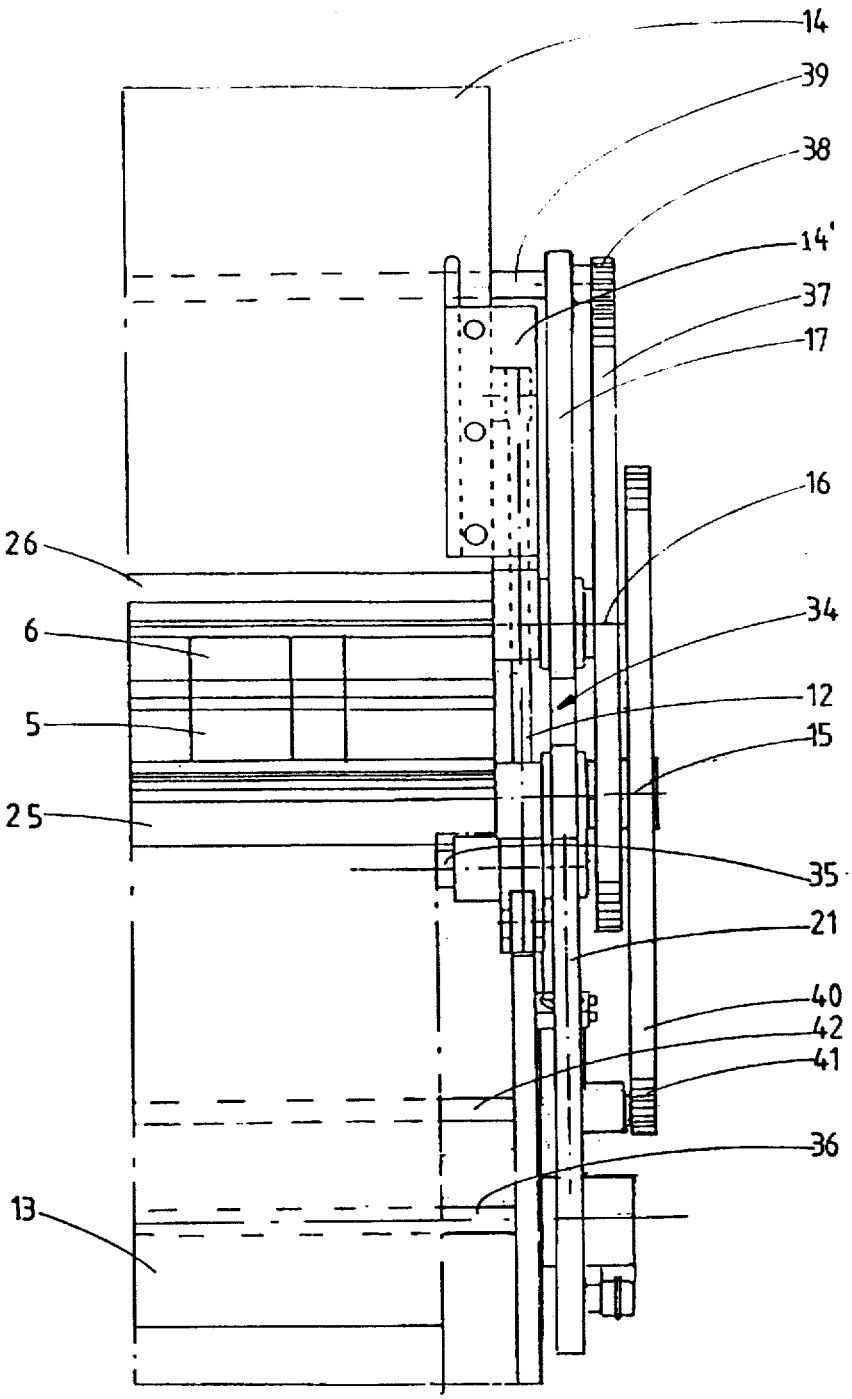
Figure 6:
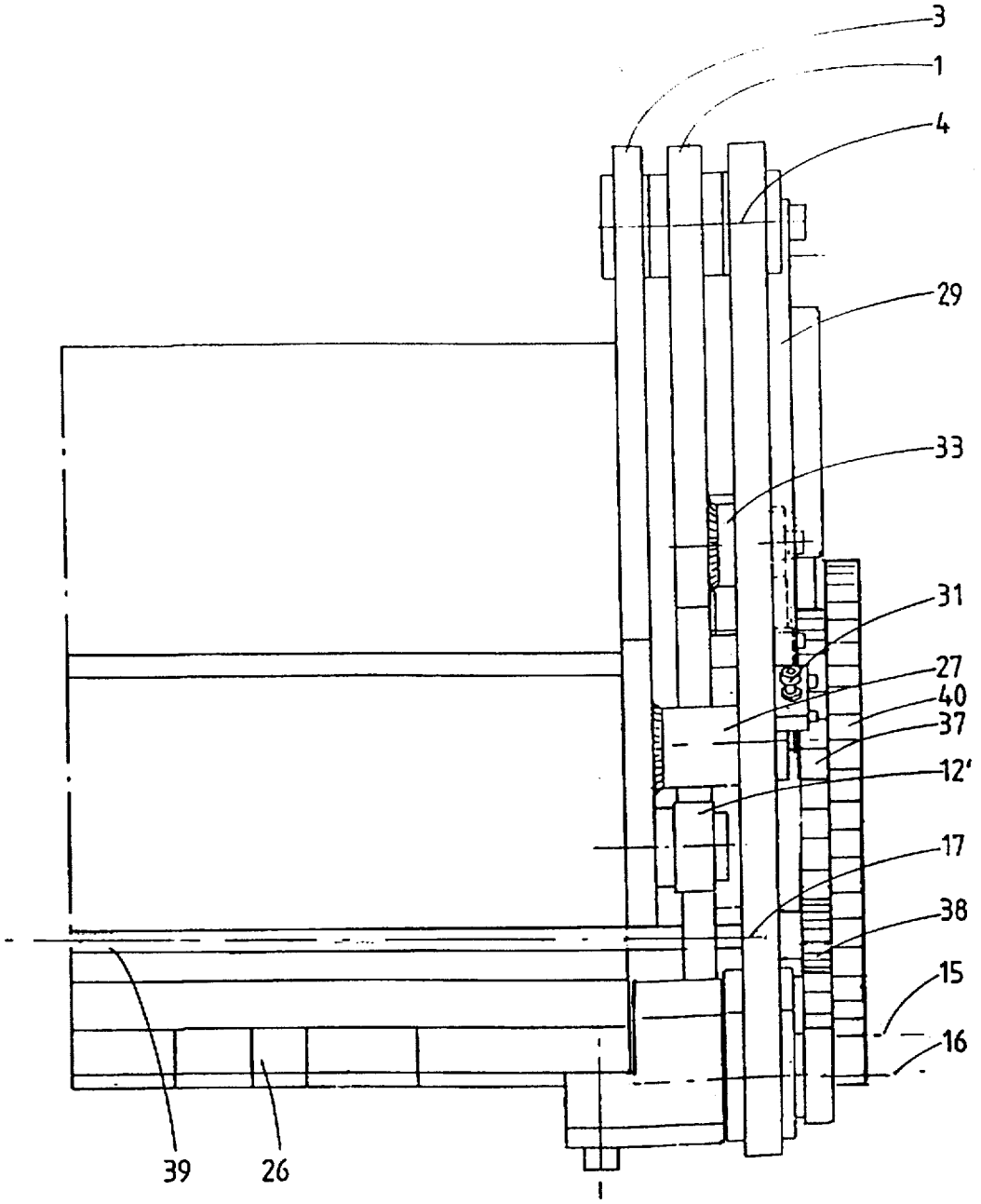

FIGS. 4–6 show an apparatus for bending metal sheet mainly corresponding with the apparatus of FIGS. 1–3, wherein the driving of the bending beams 13, 14 is simplified. For the remaining part both apparatus correspond one with the other and corresponding parts are indicated by the same reference signs and are not further described.

At both sides of the apparatus an arcuate toothed ring 37 is mounted on the axis 16 of the upper bending beam 14. Each toothed ring 37 is drivable by a pinion 38, wherein the pinions 38 lying at both sides of the apparatus are coupled by a shaft 39. This shaft 39 can be driven by an electric motor not further shown.

In a corresponding manner an arcuate toothed ring 40 is mounted on both sides of the axis 15 of the lower bending beam 13, which toothed rings can be driven by a corresponding pinion 41. The pinions 41 at both sides are coupled by a shaft 42 which can be driven by an electric motor not further shown. An arcuate slot not shown in the drawings is provided in the side plates 1 to receive the shaft 42 of the pinions 41 for driving the lower bending beam, wherein the centre of this slot coincides with the axis 4.

In this manner driving of the bending beams 13, 14 is realized in a relatively cheap and robust manner.

As indicated in FIG. 4, the shaft 42 of the pinions 41 for driving the lower bending beam 13 is located in the lowest position of the pivot plates 17 just before the front face of the lower beam 2 and behind the plane of the lower bending beam 13. In the same manner, the shafts 39 of the pinions 38 for driving the upper bending beam 14 is located in the highest position of the pivot plates 17 just before the front face of the upper beam 3 as shown by a dashed line, and behind the plane of the upper bending beam 14. By this way of mounting the shafts 39 and 42, respectively, and pinions 38 and 41, respectively, a compact construction of the apparatus is further facilitated.

The toothed rings 37 and 40 are of course made in such a manner that the recess 34 in the pivot plates 17 is not blocked.

It is noted that the apparatus is of course in a usual manner provided with a stop for determining the position of the metal plate with respect to the clamps 5, 6 and with a rotating disc for rotating in a horizontal plane the metal sheet to be bended in the apparatus. Such components are not part of the present invention and need not to be described further.

It is further noted that instead of a lower bending beam and an upper bending beam the apparatus can also be provided with a lower bending beam or an upper bending beam only. Instead of rotatable around an axis the upper beam can also be supported slidably up and down in the apparatus by means of a suitable guidance.

The invention is not restricted to the above-described embodiments which can be varied in a number of ways within the scope of the claims.

I claim:

1. An apparatus for bending metal sheet, comprising:

a frame having a front side and a backside;

a lower beam joined to the frame, the lower beam having a front wall and an upper wall;

an upper beam joined to the frame, the upper beam having a front wall and a lower wall facing the upper wall;

a clamping assembly comprising:

a lower clamp joined to the lower beam; and an upper clamp joined to the upper beam;

wherein the lower and upper clamps each have a clamping face for clamping a metal sheet in a working position therebetween;

a bending beam for bending a metal sheet clamped in the working position by said upper and lower clamps, said bending beam having a body with first and second ends and being supported in the frame for rotation around an axis independent of the upper and lower beams, said axis disposed at the front side of the frame, said body of the bending beam in a working starting position extending perpendicular to said clamping faces; and wherein said lower clamp extends obliquely upwardly and to said front side from said upper wall along a length from the upper wall to the clamping face of the lower clamp which is at least three times the thickness of said lower clamp, and said upper clamp extends obliquely downwardly and to said front side from said lower wall along a length from the lower wall to the clamping face of the upper clamp which is at least three times the thickness of said upper clamp, wherein said lower and upper clamps determine in cross-section in the working position a V-shape, the apex of which is directed towards said front side and towards the axis of the bending beam in the working position, in such a manner that forces exerted by the bending beam on a metal plate are directed at least partially towards the backside of the frame.

2. The apparatus according to claim 1, wherein said length of each of the clamps is at least five times the thickness of the clamps, respectively.

3. The apparatus according to claim 1, wherein the upper and lower beams have a triangular cross-section, and wherein said front wall of each of said beams is substantially parallel with the corresponding upper and lower clamp, respectively.

4. An apparatus for bending metal sheet, comprising:

a frame having a front side and a backside;

a stationary lower beam joined to the frame, said lower beam having a front wall and an upper wall;

a movable upper beam joined to the frame, said upper beam having a front wall and a lower wall facing the upper wall;

a clamping assembly comprising:

a lower clamp joined to the lower beam;

an upper clamp joined to the upper beam; and wherein said lower and upper clamps each have a clamping face for clamping a metal sheet in a working position therebetween;

a bending beam assembly comprising:

a lower bending beam for bending the metal sheet clamped in the working position toward the upper beam;

an upper bending beam for bending the metal sheet clamped in the working position toward the lower beam; and wherein each of said bending beams have a body with first and second ends and are supported in the frame for rotation around a corresponding axis independent of the upper and lower beam, said axes disposed at the front side of the frame, wherein each body of the lower and upper bending beams in a working starting position extends perpendicular to said clamping faces;

a pair of support plates movably joined to the frame at opposite ends thereof for supporting the upper and lower bending beams, the support plates being movable relative to the frame independent of the upper beam in a manner such that the upper bending beam and the lower bending beam can be selectively positioned adjacent the clamping faces, wherein the axis of the upper bending beam substantially lies in the plane of the clamping face of the upper clamp and the axis of the lower bending beam substantially lies in the plane of the clamping face of the lower clamp; and wherein the lower clamp extends from said upper wall obliquely upwardly and to the front side and the lower clamp extends from the lower wall obliquely downwardly and to the front side, wherein said upper and lower clamps determine in cross-section in the working position a V-shape bridging the distance between the upper and lower walls and the apex of which is directed towards said front side and towards one of the axes of the bending beams in the working position, in such a manner that forces exerted by either of the bending beams on the metal plate are directed at least partially towards the backside of the frame.

5. The apparatus according to claim 4, wherein said lower clamp extends obliquely upwardly and to said front side from said upper wall along a length from the upper wall to the clamping face of the lower clamp which is at least three times the thickness of said lower clamp, and said upper clamp extends obliquely downwardly and to said front side from said lower wall along a length from the lower wall to the clamping face of the upper clamp which is at least three times the thickness of said upper clamp.

6. The apparatus according to claim 4, wherein a distance between the axes of the bending beams is at least approximately half of a distance between the upper and lower walls of the lower and upper beams.

7. The apparatus according to claim 4, and further comprising pivot plates joined at opposite ends of the frame, the pivot plates supporting the upper beam on the frame rotatably around a pivot axis, said pivot plates being mounted between the support plates of the bending beams.

8. The apparatus according to claim 4, wherein the upper beam is supported in the frame slidably up and down by guiding means, said guiding means being mounted between the support plates of the bending beams.

9. The apparatus according to claim 7, wherein the support plates pivot about the pivot axis of the pivot plates.

10. The apparatus according to claim 9, wherein the pivot axis of the pivot plates is disposed at the backside of the frame.

11. The apparatus according to claim 8, wherein said support plates of the bending beams are slidable up and down in the frame, wherein said support plates each are guided at least two locations on the frame.

12. The apparatus according to claim 11, wherein at least one guiding location is lying at the backside of the frame and wherein one guiding location is lying above and one guiding location is lying below the axes of the bending beams.

13. The apparatus according to claim 7, wherein the pivot axis of the pivot plates lies substantially in the plane of the clamping face of the lower clamp.

14. The apparatus according to claim 4, wherein the upper beam is provided with a first stop at each end thereof and each support plate is provided with a second stop cooperating with the corresponding first stop, the first and second stops determining the position of the support plates with respect to the upper beam in such a manner that the axis of the upper bending beam is substantially lying in the plane of the clamping face of the upper clamp when the upper bending beam is moved into its working position.

15. The apparatus according to claim 14, wherein the second stops are adjustable with respect to each corresponding support plate.

16. The apparatus according to claim 14, wherein the first stop comprises a rod extending through an arcuate slot of the support plate.

17. The apparatus according to claim 4, wherein each support plate is provided with a recess located between the axes of the bending beams and directed to the backside of the frame, and wherein means are provided to locate the recesses of the support plates at the height of the clamping face to remove a bent metal sheet sidewardly from the apparatus through one of said recesses.

18. The apparatus according to claim 4, wherein the axis of each bending beam carries at both ends an arcuate toothed ring which is drivable by a corresponding pinion, wherein said pinions are mounted on a common driven shaft.

19. The apparatus according to claim 18, wherein said lower and upper bending beams each determine a beam backplane, wherein the shaft of the pinions for the lower bending beam and the upper bending beam, respectively, is located between the beam backplane of the lower bending beam and the front wall of the lower beam and the beam backplane of the upper bending beam and the front wall of the upper beam, respectively.

20. The apparatus according to claim 4, wherein the bending beams each have a front plate, wherein the bending beams carry bending elements having ends extending obliquely towards the axes in such a manner that the front plate of each bending beam is located behind a vertical plane of the corresponding axis in the starting position.

* * * * *